US011174597B2

(12) United States Patent
Ellis

(10) Patent No.: US 11,174,597 B2
(45) Date of Patent: Nov. 16, 2021

(54) SYSTEM AND METHOD FOR SECURING TUNED MASS DAMPERS TO RAIL

(71) Applicant: Polycorp Ltd., Elora (CA)

(72) Inventor: Richard Theodore Ellis, Kitchener (CA)

(73) Assignee: Polycorp Ltd., Elora (CA)

( * ) Notice: Subject to any disclaimer, the term of this patent is extended or adjusted under 35 U.S.C. 154(b) by 531 days.

(21) Appl. No.: 16/133,244

(22) Filed: Sep. 17, 2018

(65) Prior Publication Data

US 2020/0087864 A1 Mar. 19, 2020

(51) Int. Cl.

| | |
|---|---|
| ***E01B 19/00*** | (2006.01) |
| ***E01B 29/24*** | (2006.01) |
| ***E01B 29/32*** | (2006.01) |

(52) U.S. Cl.

CPC ..... *E01B 19/003* (2013.01); *E01B 29/24* (2013.01); *E01B 29/32* (2013.01); *E01B 2201/08* (2013.01)

(58) Field of Classification Search

CPC ..... E01B 19/00; E01B 19/003; E01B 26/00; E01B 29/24; E01B 29/32; E01B 2201/08

USPC ..... 238/378, 382

See application file for complete search history.

(56) References Cited

U.S. PATENT DOCUMENTS 6,213,407 B1 4/2001 Ellis et al.
6,402,044 B1 * 6/2002 Sato ..... E01B 5/08 238/382
7,234,647 B2 * 6/2007 Wirthwein ..... E01B 19/003 238/382
7,641,129 B2 * 1/2010 Farrington ..... E01B 19/003 238/382
8,763,924 B2 * 7/2014 Bosterling ..... E01B 19/003 238/382
2006/0144659 A1 * 7/2006 Wang ..... E01B 19/003 188/379
2009/0294546 A1 * 12/2009 Bedford ..... E01B 26/00 238/351
2015/0345083 A1 12/2015 Veit
(Continued)

FOREIGN PATENT DOCUMENTS

EP 1015698 B1 4/2004

OTHER PUBLICATIONS

The Noise-Absorber System, Strailastic_A, Kraiburg Elastik GmbH, Feb. 2015.

(Continued)

*Primary Examiner* — Zachary L Kuhfuss

(57) ABSTRACT

A clip assembly for securing first and second tuned mass dampers to respective first and second sides of a rail. The clip assembly includes a bar element having a connector portion extending between first and second ends thereof and formed to be positioned in a predetermined location relative to the rail at least partially under a foot of the rail, and a first clamping arm connected with the connector portion at the first end of the connector portion, the first clamping arm being formed to engage the first tuned mass damper. The bar element also includes a linkage section located at the second end of the connector portion. The clip assembly includes a second clamping arm extending between upper and lower ends thereof, the lower end comprising a locking portion securable to the linkage section, and the upper end being formed for engagement with the second tuned mass damper.

20 Claims, 11 Drawing Sheets

(56) References Cited

U.S. PATENT DOCUMENTS

2020/0087862 A1* 3/2020 Ellis ..... E01B 19/003
2020/0087864 A1* 3/2020 Ellis ..... E01B 29/24

OTHER PUBLICATIONS

Silent Track, Reducing Railway Noise, Tata Steel Europe Ltd., Apr. 2014.
Shock and Vibration Technology, Schrey & Veit, www.railway-technology.com/contractors/noise/schrey, Verdict Media Limited, downloaded Aug. 28, 2018.
Granuflex-Rail, Flexible Solutions, Rubber Products 2015, www.granuflex.hu, Dec. 2015.

* cited by examiner

SYSTEM AND METHOD FOR SECURING TUNED MASS DAMPERS TO RAIL

FIELD OF THE INVENTION

The present invention is a system and a method for securing tuned mass dampers to rail.

BACKGROUND OF THE INVENTION

Various devices for securing rail seals to a rail are known. The rail seals typically are used at level crossings, where the rail seals and the clips used to hold the rail seals in place are typically buried under asphalt or concrete at the level crossing, after installation. A clip assembly for a rail seal is illustrated and described in U.S. Pat. No. 6,213,407. Because the clip assembly and the rail seal held thereby are intended to be covered by asphalt or concrete, the extent to which the clip assembly extends outwardly from the rail is generally not important.

In contrast, tuned mass dampers may be attached or secured to linear rails, along the lengths of rail outside the level crossings. The tuned mass dampers primarily are designed to minimize the extent to which vibrations resulting from traffic over the rails may be transmitted as airborne noise. As is known in the art, the tuned mass dampers are formed to have a mass and an overall density designed to dampen vibrations of the rail generated by the movement of rail car wheels along the rail.

It is important that the installed tuned mass dampers, and the devices holding them to the rail, extend outwardly from the rail only a relatively short distance. This is in contrast to the less onerous requirements for conventional clip assemblies securing rail seals at level crossings, described above. Along the exposed parts of the rail that are located outside the level crossings, the devices that secure the tuned mass dampers to rails are required to fit within a relatively small envelope or perimeter relative to the rail. This is due to the routine rail and track bed maintenance tasks (e.g., ballast tamping, and rail grinding) that are required to be done to the rail and ballast located outside the level crossings. In order for these routine maintenance tasks to be completed efficiently, the tuned mass dampers and the clips holding them may extend outwardly from the track only a relatively short distance.

The prior art devices that have been used to secure tuned mass dampers to a rail outside the level crossings are generally unsatisfactory because they are relatively expensive, and/or difficult to use, and/or ineffective.

SUMMARY OF THE INVENTION

There is a need for a system and a method for securing tuned mass dampers to a rail that overcome or mitigate one or more of the disadvantages or defects of the prior art. Such disadvantages or defects are not necessarily included in those described above.

In its broad aspect, the invention provides a clip assembly for securing first and second tuned mass dampers to respective first and second sides of a rail. The clip assembly includes a bar element having a connector portion extending between first and second ends thereof and formed to be positioned in a predetermined location relative to the rail at least partially under a foot of the rail, a first clamping arm connected with the connector portion at the first end of the connector portion, the first clamping arm being formed to engage the first tuned mass damper to urge the first tuned mass damper against the first side of the rail and at least partially downwardly toward the foot, when the connector portion is in the predetermined location, and a linkage section connected with the connector portion at the second end of the connector portion, the linkage section comprising a curved wall with an opening therein. The clip assembly also includes a second clamping arm extending between upper and lower ends thereof. The lower end includes a locking portion at least partially receivable in the opening in the curved wall. The locking portion is securable to the linkage section, and the upper end is formed for engagement with the second tuned mass damper, to urge the second tuned mass damper against the second side of the rail and at least partially downwardly toward the foot.

In another aspect, the invention provides a system including a clip assembly for securing first and second tuned mass dampers on respective first and second sides of a rail. The clip assembly includes a bar element having a connector portion extending between first and second ends thereof and formed to be positioned in a predetermined location relative to the rail at least partially under a foot of the rail, a first clamping arm connected with the connector portion at the first end of the connector portion, the first clamping arm being formed to engage the first tuned mass damper to urge the first tuned mass damper against the first side of the rail and at least partially downwardly toward the foot, when the connector portion is in the predetermined location, and a linkage section connected with the connector portion at the second end of the connector portion, the linkage section comprising a curved wall with an opening therein. The clip assembly also includes a second clamping arm extending between upper and lower ends thereof. The lower end includes a locking portion at least partially receivable in the opening in the curved wall. The locking portion is securable to the linkage section. The upper end is formed for engagement with the second tuned mass damper, to urge the second tuned mass damper against the second side of the rail and at least partially downwardly toward the foot. The system also includes an installation tool configured for engagement with the curved wall and the second clamping arm, for urging the first and second clamping arms against the first and second tuned mass dampers respectively, and to secure the locking portion to the linkage section.

In another of its aspects, the invention provides a method of installing a clip assembly for securing first and second tuned mass dampers on respective first and second sides of a rail. The method includes inserting a linkage section of a bar element of the clip assembly underneath a first side of a foot of the rail. The linkage section is pushed in a first direction underneath the foot of the rail, to position a connector portion of the bar element in a predetermined location relative to the first and second tuned mass dampers, and to engage a first clamping arm that is connected with the connector portion with the first tuned mass damper. A locking portion body of a locking portion at the lower end of a second clamping arm of the clip assembly is inserted into an opening in a curved wall of the linkage section, to engage a locking element positioned on a lower surface of the locking portion body with a lower edge element of the curved wall that partially defines the opening, to hold the locking portion of the second clamping arm in the linkage section. An installation tool is positioned to engage one or more first contact portions thereof with the bracing element, and to engage one or more second contact portions thereof with the bearing surface of the second clamping arm. With the first contact portion, the bracing element is pulled at least partially in the first direction, to urge the first clamping arm in the first direction against the first tuned damper element, and simultaneously with the second contact portion, urging the second clamping arm in the second direction against the second tuned damper element.

In yet another of its aspects, the invention also provides a pair of tuned mass dampers for damping airborne vibrations from a rail generated by movement of wheels over the rail, the rail including a web portion supported by a foot thereof. Each of the tuned mass dampers includes a body including an elastomeric material and one or more insert elements embedded in the elastomeric material. The body also includes an inner side formed for engagement with the web portion and an outer side of the body opposite to the inner side thereof, the outer side having an upper part and a lower part formed to be located below the upper part when the inner side of the tuned mass damper is engaged with the web portion. The upper and lower parts are at least partially separated by a slot with a recessed region therein defined by upper and lower surfaces positioned at least partially inwardly from the outer side.

The invention also provides a system for damping airborne vibrations from a rail generated by wheels rolling over the rail, the rail including a web portion supported by a foot. The system includes first and second tuned mass dampers, the first and second tuned mass dampers being engaged with opposite first and second sides of the web portion and being at least partially supported by the foot of the rail. The system also includes a clip assembly for securing the first and second tuned mass dampers to the respective first and second sides of a rail. The clip assembly includes a bar element having a connector portion extending between first and second ends thereof and formed to be positioned in a predetermined location relative to the rail at least partially under the foot of the rail, a first clamping arm connected with the connector portion at the first end of the connector portion, the first clamping arm being formed to engage a lower surface of the first tuned mass damper to urge the first tuned mass damper against the first side of the rail and at least partially downwardly toward the foot, when the connector portion is in the predetermined location. The bar element also includes a linkage section connected with the connector portion at the second end of the connector portion, the linkage section including a curved wall with an opening therein. The clip assembly also includes a second clamping arm extending between upper and lower ends thereof. The lower end includes a locking portion at least partially receivable in the opening in the curved wall. The locking portion is securable to the linkage section, and the upper end is formed for engagement with the lower surface of the second tuned mass damper, to urge the second tuned mass damper against the second side of the rail and at least partially downwardly toward the foot.

BRIEF DESCRIPTION OF THE DRAWINGS

The invention will be better understood with reference to the attached drawings, in which.

DETAILED DESCRIPTION

Figure 1A:
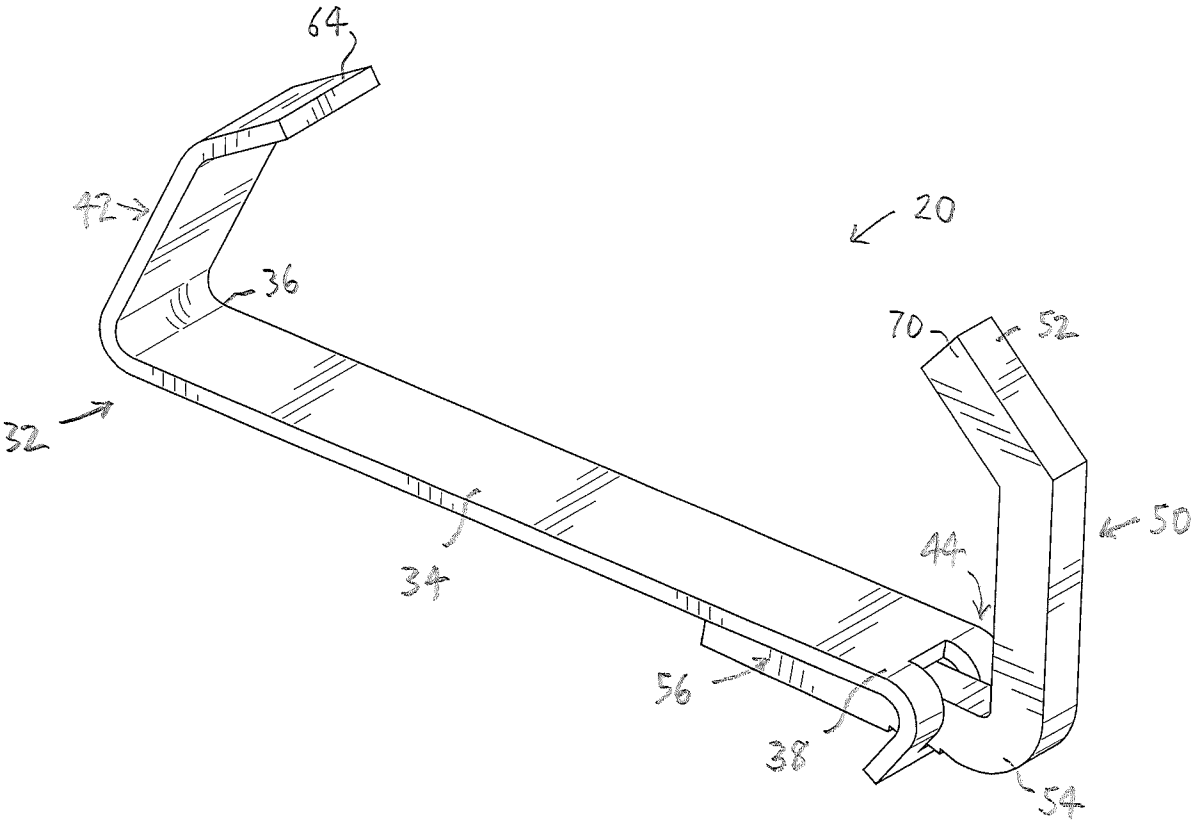
FIG. 1A is an isometric view of an embodiment of a clip assembly of the invention.
Figure 1B:
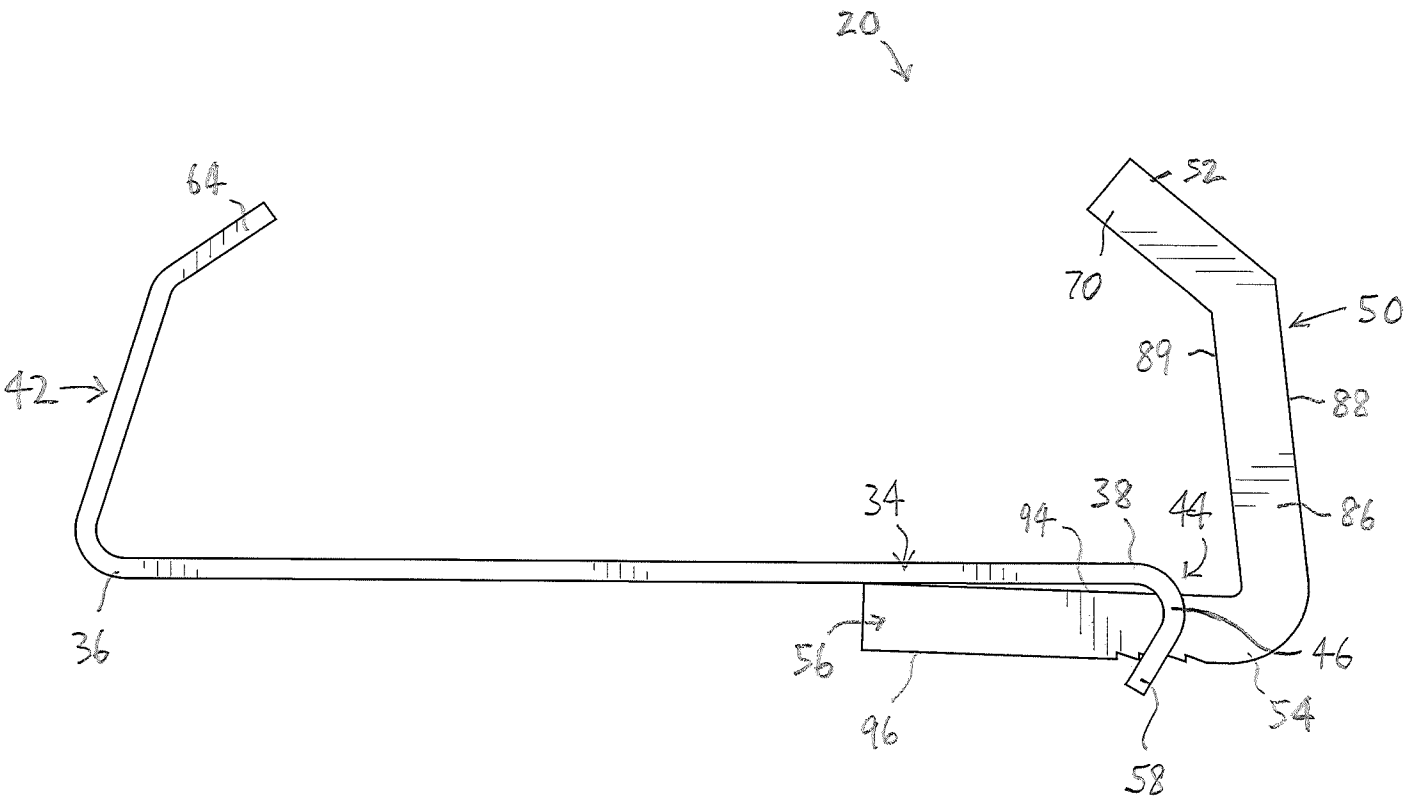
FIG. 1B is a side view of the clip assembly of FIG. 1A.
Figure 1C:
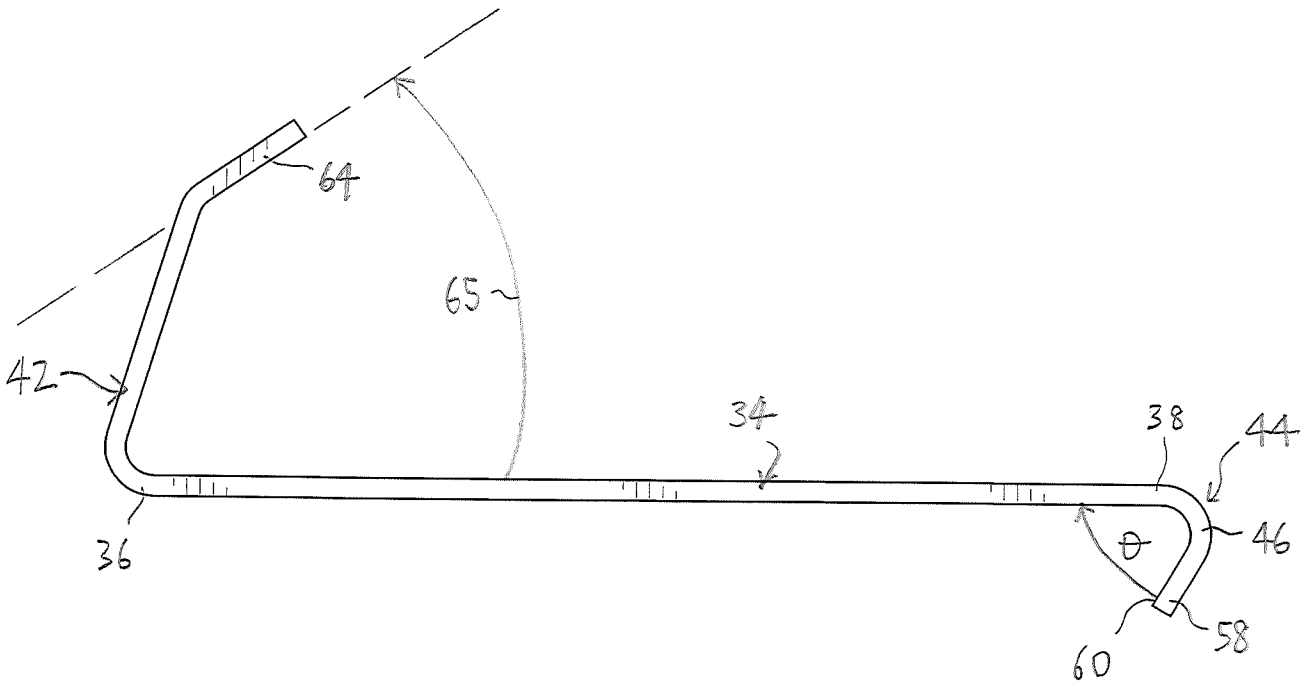
FIG. 1C is a side view of a bar element of the clip assembly of FIG. 1A.

In the attached drawings, like reference numerals designate corresponding elements throughout. Reference is first made to FIGS. 1A-2B to describe an embodiment of a clip assembly of the invention indicated generally by the numeral 20. As will be described, the clip assembly 20 is for securing first and second tuned mass dampers 22, 24 to respective first and second sides 26, 28 of a rail 30 (FIG. 2A). In one embodiment, the clip assembly 20 preferably includes a bar element 32, which has a connector portion 34 extending between first and second ends 36, 38 thereof (FIGS. 1A, 1B) and which is formed to be positioned in a predetermined location relative to the rail 30 at least partially under a foot 40 of the rail 30 (FIG. 2A). It is also preferred that the bar element 34 includes a first clamping arm 42 connected with the connector portion 34 at the first end 36 of the connector portion 34 (FIGS. 1A, 1B). As will also be described, the first clamping arm 42 preferably is formed to engage the first tuned mass damper 22, to urge the first tuned mass damper 22 against the first side 26 of the rail 30 and at least partially downwardly toward the foot 40, when the connector portion 34 is in the predetermined location (FIG. 2A).

Figure 2A:
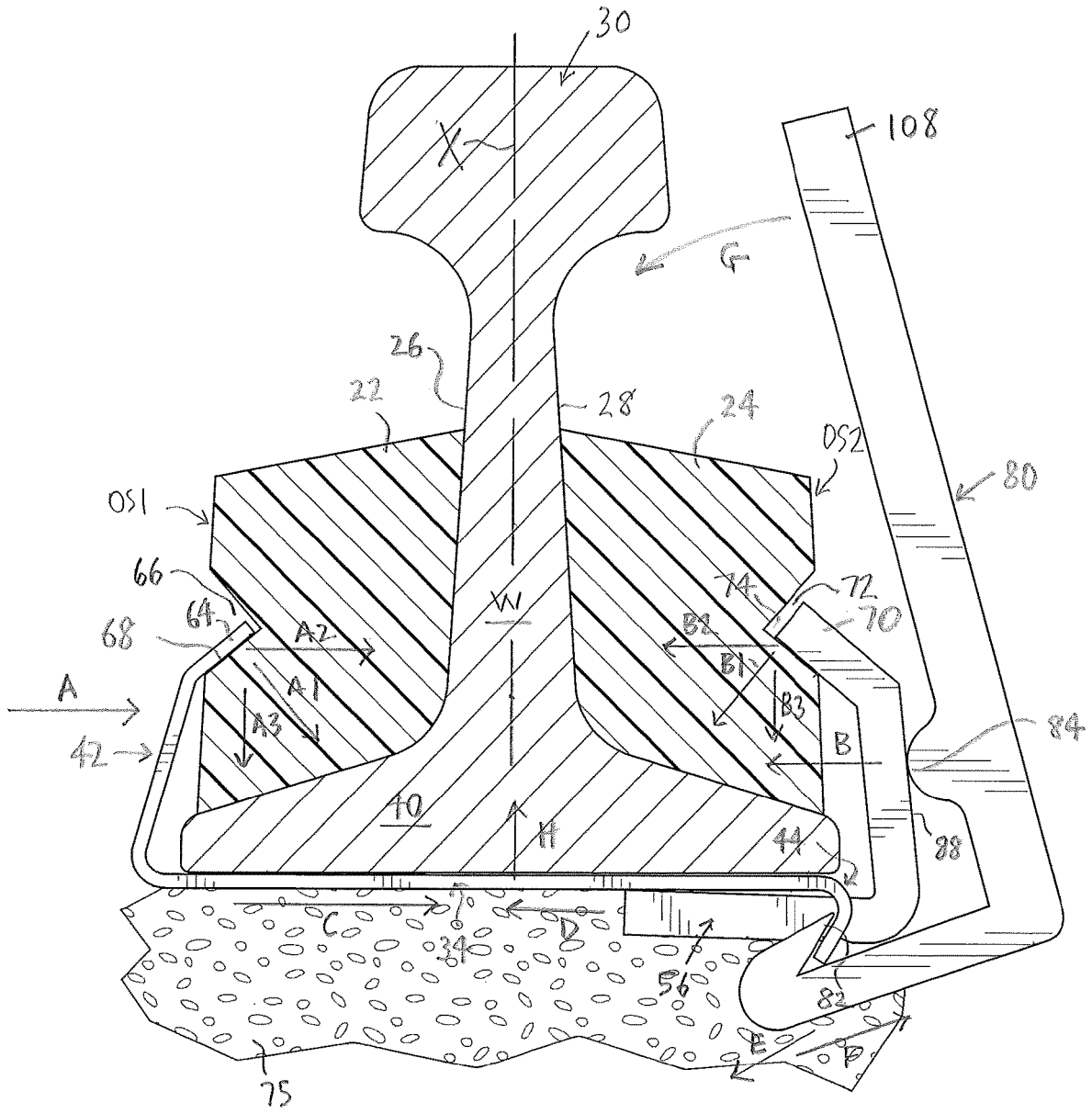
FIG. 2A is a cross-section of a rail and first and second tuned mass dampers secured to the rail and a side view of the clip assembly of FIG. 1A, securing the tuned mass dampers to the rail, with an embodiment of an installation tool of the invention engaged with the clip assembly.
Figure 2B:
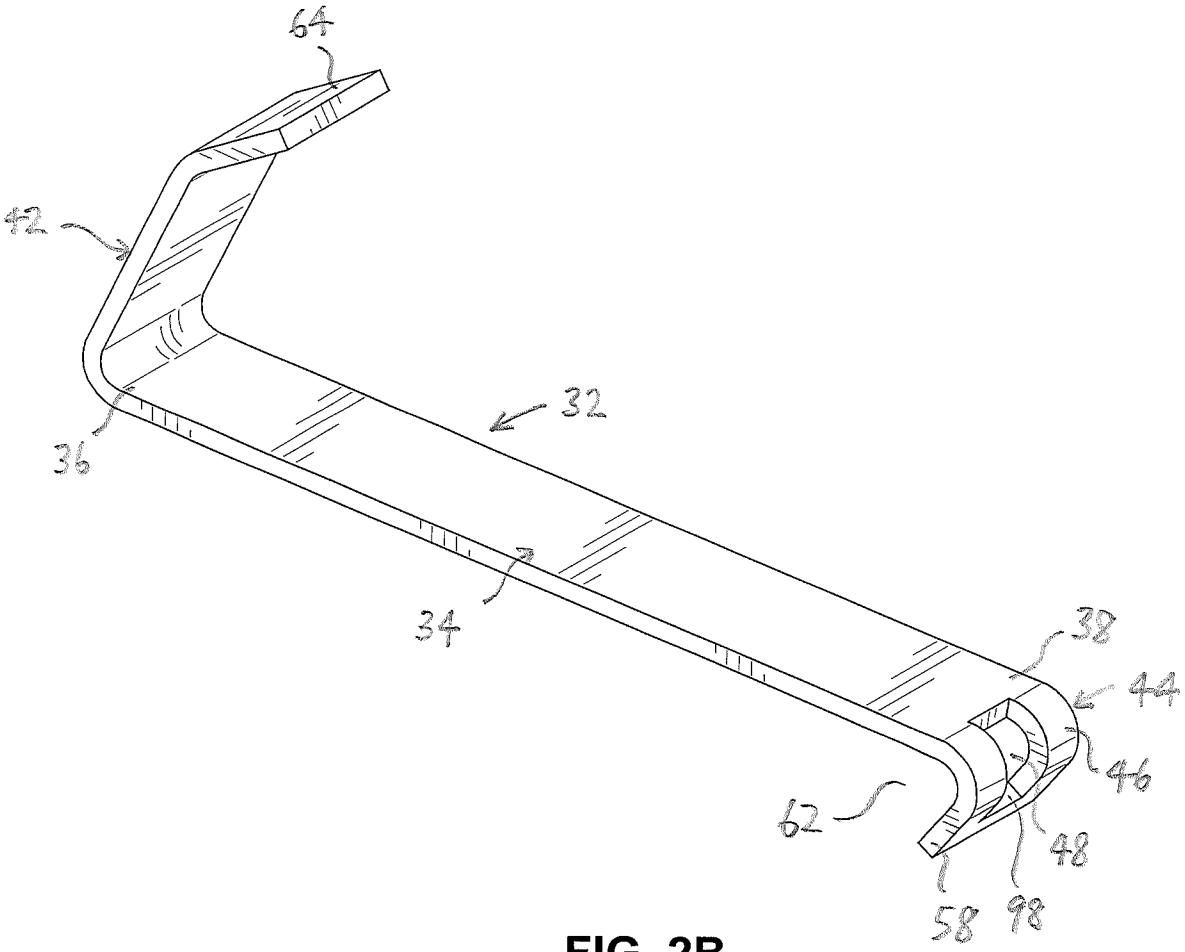
FIG. 2B is an isometric view of an embodiment of a bar element of the invention.

The bar element 32 preferably also includes a linkage section 44 connected with the connector portion 34 at the second end 38 of the connector portion 34. As can be seen in FIG. 2B, the linkage section 44 preferably includes a curved wall 46 with an opening 48 therein.

Figure 1D:
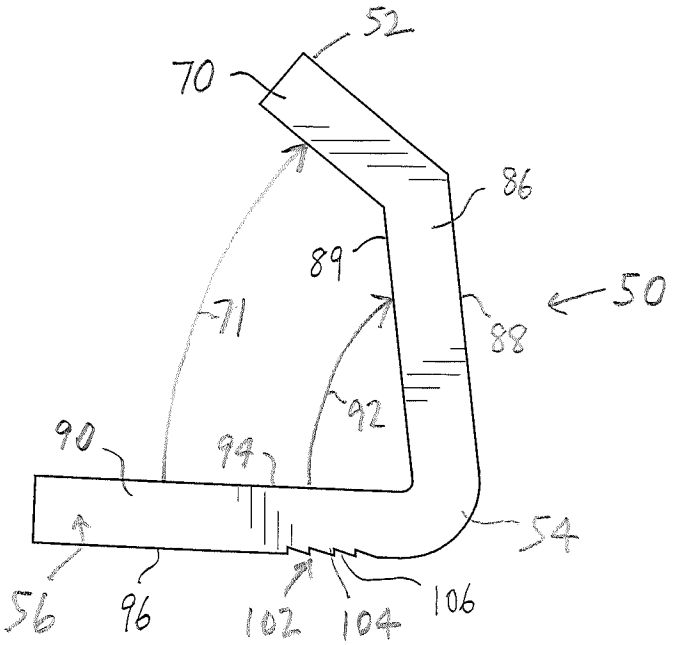
FIG. 1D is a side view of a second clamping arm of the clip assembly of FIG. 1A.
Figure 2C:
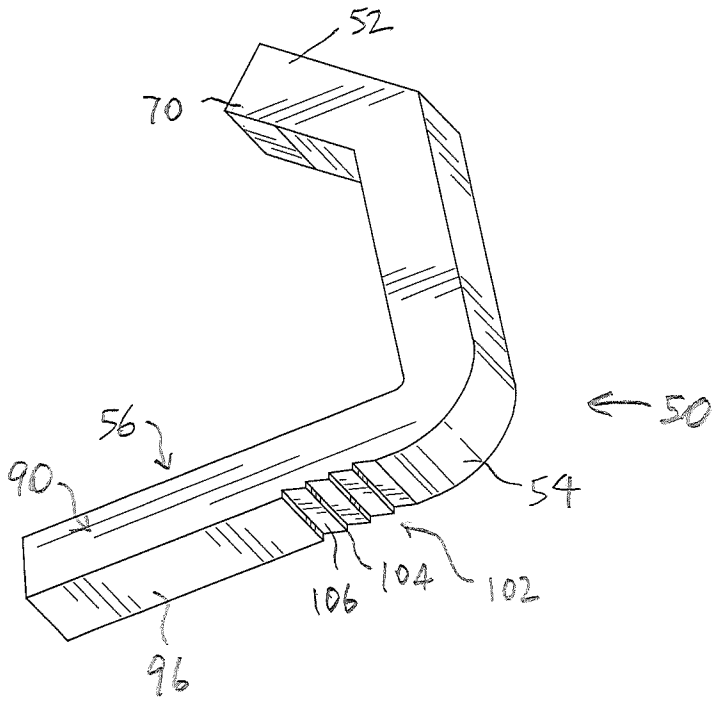
FIG. 2C is an isometric view of an embodiment of a second clamping arm of the invention.

In one embodiment, the clip assembly 20 preferably also includes a second clamping arm 50 extending between upper and lower ends 52, 54 thereof (FIGS. 1D, 2C). Preferably, the lower end 54 includes a locking portion 56 (FIG. 1D) that is at least partially receivable in the opening 48 in the curved wall 46. The locking portion 56 preferably is securable to the linkage section 44, as will also be described. It is also preferred that the upper end 52 is formed for engagement with the second tuned mass damper 24, to urge the second tuned mass damper 24 against the second side 28 of the rail 30 and at least partially downwardly toward the foot 40.

As will be described, the first and second sides 26, 28 are sides of a web portion "W" of the rail 30.

As can be seen in FIGS. 1B, 10, and 2B, in one embodiment, the curved wall 46 preferably also includes one or more bracing elements 58. The bracing element 58 preferably includes an interior surface 60 defining a gap 62 between the interior surface 60 and the connector portion 34 (FIG. 2B). It is also preferred that the interior surface 60 is planar, or at least partially planar, and defines an acute angle Θ between the interior surface 60 and the connector portion 34 (FIG. 10).

As can be seen in FIGS. 1B, 10, and 2A, in one embodiment, the first clamping arm 42 preferably includes a first engagement portion 64, for engaging the first tuned mass damper 22. Preferably, the first engagement portion 64 defines a first acute angle 65 between the first engagement portion 64 and the connector portion 34 (FIG. 10).

It can also be seen in FIG. 2A that the first tuned mass damper 22 includes a recessed region 66 that is partially defined by a lower surface 68, and the first engagement portion 64 preferably is configured to mate with the lower surface 68. The lower surface 68 preferably is substantially planar, and also defines an acute angle 65' (FIG. 4C) relative to the horizontal that is substantially the same as the acute angle 65 between the lower surface 68 and the connector portion 34.

The first engagement portion 64 preferably is located relative to the connector portion 34 so that, when the first clamping arm 42 is urged in a first direction (generally indicated by arrow "A" in FIG. 2A) against the first tuned mass damper 22, the first engagement portion 64 engages the lower surface 68. As noted above, in one embodiment, the lower surface 68 may be substantially parallel to the first engagement portion 64.

When the first engagement portion 64 engages the lower surface 68 and is urged against the lower surface 68, the force exerted by the first engagement portion 64 (schematically represented by arrow "A1" in FIG. 2A) against the first tuned mass damper 22 may be characterized or represented as comprising two components, namely, a horizontal component (schematically represented by arrow "A2" in FIG. 2A) toward the rail, and a vertical component (schematically represented by arrow "A3" in FIG. 2A).

As illustrated in FIG. 2A, the force exerted by the first engagement portion 64 upon the lower surface 68 is directed at an angle of approximately 40° from the vertical. Also, as illustrated, the direction of the resulting pressure on the lower surface 68 is substantially orthogonal to the lower surface 68. However, it will be understood that the direction of the force schematically represented by arrow "A1" in FIG. 2A is exemplary only. Those skilled in the art would appreciate that the direction of the pressure resulting from the engagement of the first engagement portion with the lower surface 68 may be over a variety of directions, depending on various parameters.

As can be seen in FIG. 2A, when the first engagement portion 64 is urged against the lower surface 68, the first engagement portion 64 partially exerts a horizontally directed force (schematically represented by arrow "A2" in FIG. 2A) toward the rail 30, and partially exerts a downwardly directed force (schematically represented by arrow "A3" in FIG. 2A) that is directed generally toward the foot 40 of the rail 30.

The Applicant has determined that the tuned mass dampers 22, 24 are more effective at damping airborne vibration (i.e., noise) when they are at least partially urged downwardly, against the foot 40 of the rail 30. That is, a tuned mass damper that is solely urged in a substantially horizontal direction by engagement of the first engagement portion 64 with the lower surface 68 has been found to dampen noise less effectively than if the tuned mass damper were urged both horizontally and downwardly (i.e., as illustrated for exemplary purposes in FIG. 2A), upon engagement of the lower surface 68 by the first engagement portion 64.

It is also preferred that the second clamping arm 50 includes a second engagement portion 70 at the upper end 52 thereof, for engaging the second tuned mass damper 24. As can be seen in FIG. 1D, the second engagement portion 70 preferably defines a second acute angle 71 between the second engagement portion 70 and the locking portion 56.

It can also be seen in FIG. 2A that the second tuned mass damper 24 includes a recessed region 72 that is partially defined by a lower surface 74, and the second engagement portion 70 preferably is configured to mate with the lower surface 74. The lower surface 74 preferably is substantially planar, and also defines an acute angle relative to the horizontal that is substantially the same as the acute angle 71 between the lower surface 74 and the connector portion 34.

The second engagement portion 70 preferably is located relative to the locking portion 56 so that, when the second clamping arm 50 is urged in a second direction (generally indicated by arrow "B" in FIG. 2A) against the second tuned mass damper 24, the second engagement portion 70 engages the lower surface 74. As noted above, in one embodiment, the lower surface 74 may be substantially parallel to the second engagement portion 70.

When the second engagement portion 70 engages the lower surface 74 and is urged against the lower surface 74, the force exerted by the second engagement portion 70 (schematically represented by arrow "B1" in FIG. 2A) against the second tuned mass damper 24 may be characterized or represented as comprising two components, namely, a horizontal component (schematically represented by arrow "B2" in FIG. 2A) toward the rail, and a vertical component (schematically represented by arrow "B3" in FIG. 2A).

As illustrated in FIG. 2A, the force exerted by the second engagement portion 70 upon the lower surface 74 is directed at an angle of approximately 40° from the vertical. Also, as illustrated, the direction of the resulting pressure on the lower surface 74 is substantially orthogonal to the lower surface 74. However, it will be understood that the direction of the force schematically represented by arrow "B1" in FIG. 2A is exemplary only. Those skilled in the art would appreciate that the direction of the pressure resulting from the engagement of the second engagement portion with the lower surface 74 may be directed over a variety of directions, depending on various parameters.

Those skilled in the art would appreciate that the forces schematically represented by the arrows "A1" and "B1" in FIG. 2A preferably are substantially symmetrical relative to a vertical axis (identified by "X" in FIG. 2A) of the rail 30.

As can be seen in FIG. 2A, when the second engagement portion 70 is urged against the lower surface 74, the second engagement portion 70 partially exerts a horizontally directed force (schematically represented by arrow "B2" in FIG. 2A) toward the rail 30, and partially exerts a downwardly directed force (schematically represented by arrow "B3" in FIG. 2A) that is directed generally toward the foot 40 of the rail 30.

As noted above, the Applicant has determined that the tuned mass dampers 22, 24 are more effective at damping airborne vibration (i.e., noise) when they are at least partially urged downwardly, against the foot 40 of the rail 30.

As can be seen in FIG. 2A, it is preferred that the first and second tuned mass dampers 22, 24 are positioned on opposite sides of the rail 30. It will be understood that the second tuned mass damper 24 is the mirror image of the first tuned mass damper 22. Accordingly, to avoid repetition, only the first tuned mass damper 22 is described herein in detail.

Figure 4A:
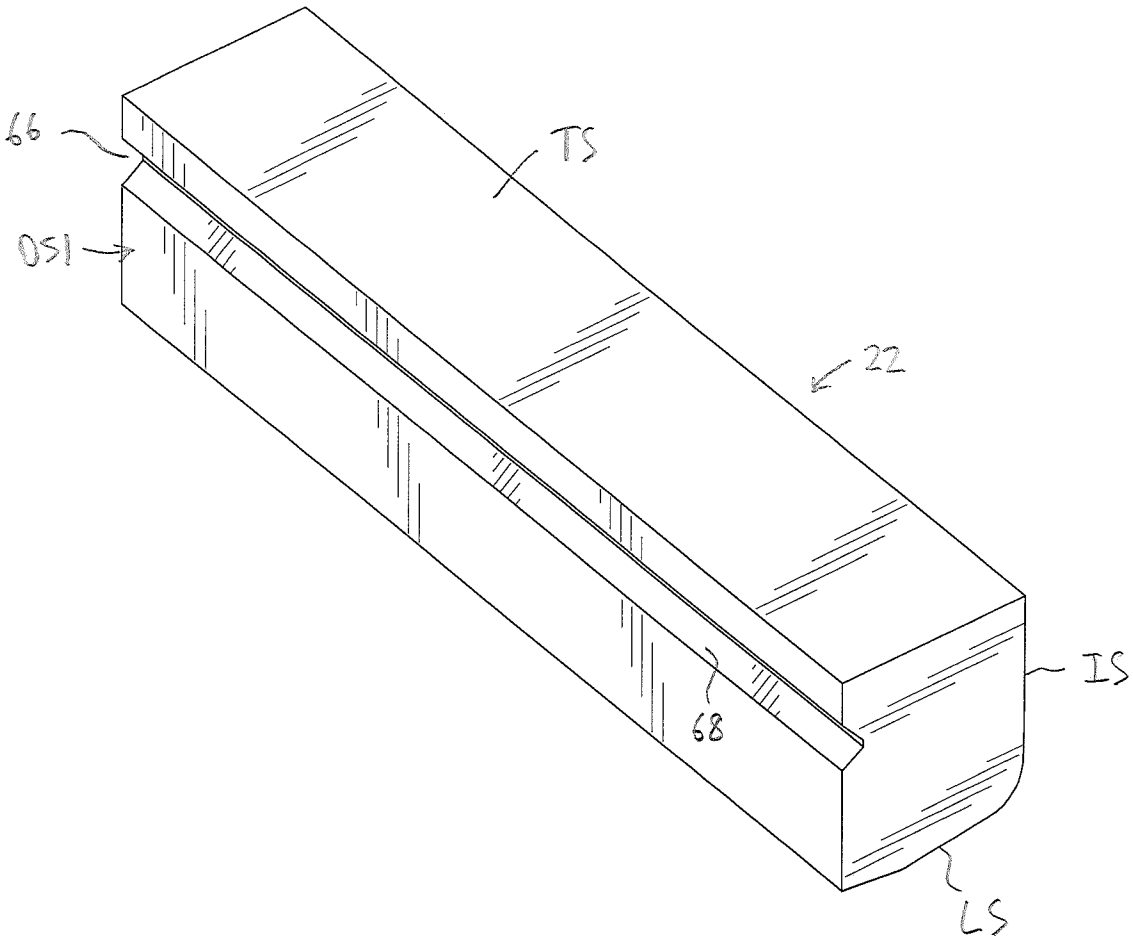
FIG. 4A is an isometric view of an embodiment of a tuned mass damper of the invention, drawn at a smaller scale.
Figure 4B:
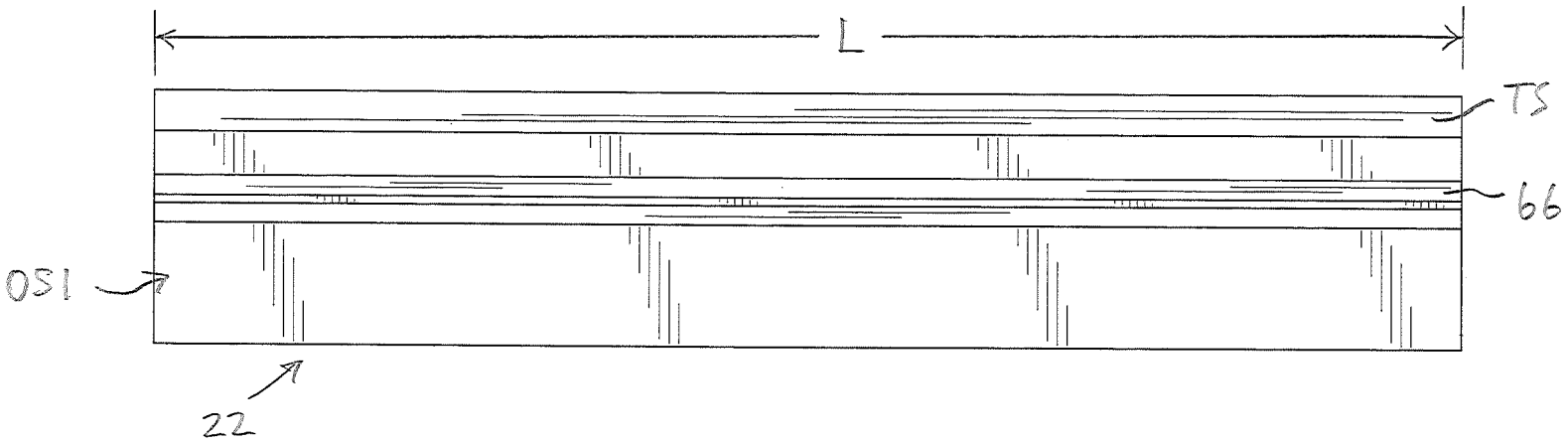
FIG. 4B is a side view of the tuned mass damper of FIG. 4A.
Figure 4C:
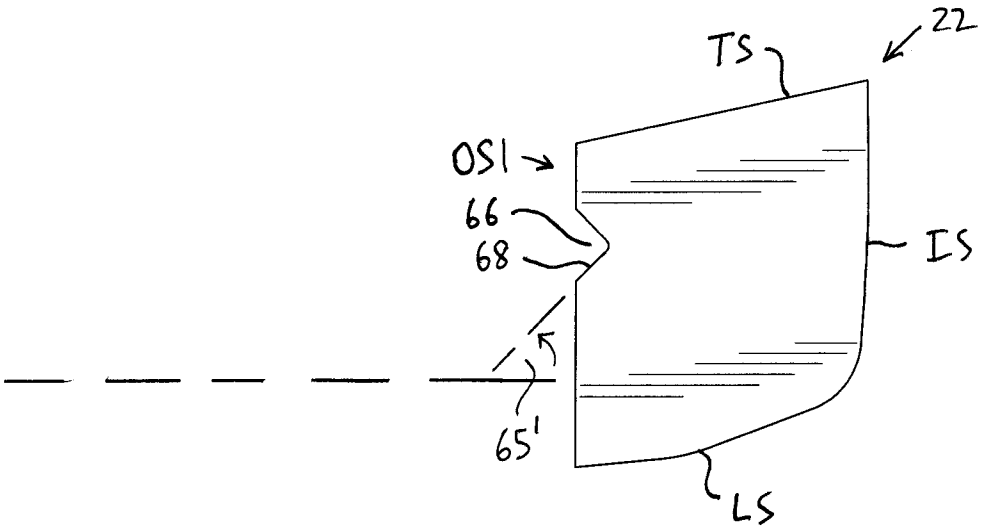
FIG. 4C is an end view of the tuned mass damper of FIGS. 4A and 4B.

The first tuned mass damper 22 is also illustrated in FIGS. 4A-4C. As can be seen in FIGS. 4A and 4B, the first tuned mass damper 22 has a length "L". The tuned mass damper may have any suitable length. In one embodiment, it is preferred that the tuned mass damper is formed to fit between railway ties. The length of the tuned mass damper therefore may depend, for instance, on the spacing between the railway ties. For instance, the tuned mass damper may have a length of approximately 12 to 18 inches.

As can be seen in FIG. 2A, the first and second tuned mass dampers 22, 24 preferably are at least partially defined by substantially vertical outer surfaces "OS1", "OS2" that are interrupted by the recessed regions 66 and 72 respectively.

Those skilled in the art would appreciate that the tuned mass dampers may be made of any suitable material, or combination of materials, to provide a tuned mass damper with suitable density and stiffness. The tuned mass dampers ideally have densities and other physical characteristics so that the tuned mass dampers, once secured to the rail, minimize airborne noise. For instance, in one embodiment, the tuned mass dampers may include pieces of steel embedded in an elastomeric matrix.

As can be seen in FIGS. 4A-4C, the tuned mass damper preferably is formed with an inner side "IS" configured to mate with the web portion "W" of the rail 30, and a lower side "LS" configured to mate with the foot 40. The inner side "IS" of the first tuned mass damper 22 is formed to mate with the first side 26 of the web portion "W", and the inner side "IS" of the second tuned mass damper 24 is formed to mate with the second side 28 of the web portion "W". Preferably, the tuned mass damper also includes a top surface "TS" formed for drainage of water outwardly therefrom, away from the rail 30.

As noted above, it is important that the extent to which the clip assembly 20, once installed, extends laterally outwardly from the outer sides "OS1" and "OS2" be minimized. Preferably, the sizes of the tuned mass dampers are minimized. Because of the recessed regions 66, 72, once the clip assembly 20 is installed, the extent to which the first and second clamping arms 44, 50 extend laterally outwardly from the outer sides "OS1" and "OS2" is minimized.

As will be described, it is preferred that the clip assembly 20 initially is manually positioned on the first and second tuned mass dampers 22, 24, and also on the rail 30. It will be understood that, when the clip assembly 20 has been manually positioned on the first and second tuned mass dampers 22, 24, the first and second engagement portions 64, 70 may only lightly engage the respective lower surfaces 68, 74. Once the clip assembly 20 is positioned so that the first and second engagement portions 64, 70 engage the lower surfaces 68, 74, the second clamping arm 50 is urged in the direction indicated by arrow "B", and the first clamping arm 42 is urged in the direction indicated by arrow "A", to install the clip assembly 20 against the first and second tuned mass dampers 22, 24.

As a practical matter, it is convenient for a user (not shown) to manually position the bar element 32 so that the linkage section 44 is positioned underneath the foot 40, proximal to the second tuned mass damper 24, and the first engagement portion 64 is at least proximal to the lower surface 68 of the first tuned mass damper 22 (FIG. 2A). Once the bar element 32 is so positioned, the second clamping arm 50 preferably is engaged therewith, by the user inserting the locking portion 56 of the second clamping arm 50 into the opening 48 in the curved wall 46 of the linkage section 44. Preferably, the user then pushes the second clamping arm 50 toward the second tuned mass damper 24, to lightly engage the second engagement portion 70 with the lower surface 74 of the second tuned mass damper 24.

Those skilled in the art would appreciate that the rail 30 may be supported by sleepers or railway ties (not shown) that are spaced apart from each other along the rail 30. Ballast 75 is located between the railway ties (FIG. 2A), and also under the railway ties. FIG. 2A includes a cross-section of the rail 30 and of the first and second tuned mass dampers 22, 24 taken between two of the railway ties. It will be understood that, in use, a number of the clip assemblies 20 preferably are positioned along the rail 30, spaced apart from each other at selected locations between the railway ties.

Those skilled in the art would appreciate that, in order to install the clip assembly 20, the linkage section 44 of the bar element 32 is first inserted into the ballast 75, underneath a left (or first) side 76 of the foot 40 (FIG. 2A). The bar element 32 preferably is then pushed in a third direction (indicated by arrow "C" in FIG. 2A) that is generally the same as the first direction, but may be non-horizontal. As illustrated in FIG. 2A, the third direction is generally from left to right.

Those skilled in the art would also appreciate that the amount of the ballast 75 at respective locations along the track relative to the rail may vary. It is preferred that the clip assembly 20 is installed at a location along the track where there is somewhat less ballast 75 present, to permit easier installation of the clip assembly 20.

The bar element 32 preferably is manually pushed in the direction indicated by arrow "C" until the first engagement portion 64 engages the lower surface 68 of the first tuned mass damper 22. As noted above, the first engagement portion 64 may only lightly engage the lower surface 68, because the installation at this point is done manually. When the bar element 32 is at the point where the first engagement portion 64 lightly engages the lower surface 68, the connector portion 34 of the bar element 32 is in its predetermined location. It is preferred that, when the connector portion 34 is in the predetermined location therefor, the connector portion 34 is horizontal, or substantially horizontal, as illustrated in FIG. 2A. However, those skilled in the art would appreciate that the connector portion 34 may alternatively be located underneath the foot 40 in a position that is non-horizontal.

As can be seen in FIG. 2A, when the connector portion 32 is in its predetermined location, the linkage section 44 preferably is located proximal to a right (or second) side 78 of the foot 40. The second side 78 of the foot 40 is located generally below the second tuned mass damper 24. Once the connector portion 34 is in the predetermined location therefor, it is preferred that the locking portion 56 of the second clamping arm 50 is inserted into the opening 48 in the curved wall 46, and the second clamping arm 50 is moved manually in a fourth direction indicated by arrow "D" in FIG. 2A until the second engagement portion 70 engages the lower surface 74 of the second tuned mass damper 24. As noted above, at this point, although the first and second engagement portions 64, 70 preferably are engaging the respective lower surfaces 68, 74, the first and second engagement portions 64, 70 preferably are subjected to only minimal pressure, i.e., only such pressure as may be needed in order to locate them on the respective lower surfaces 68, 74.

Figure 3:
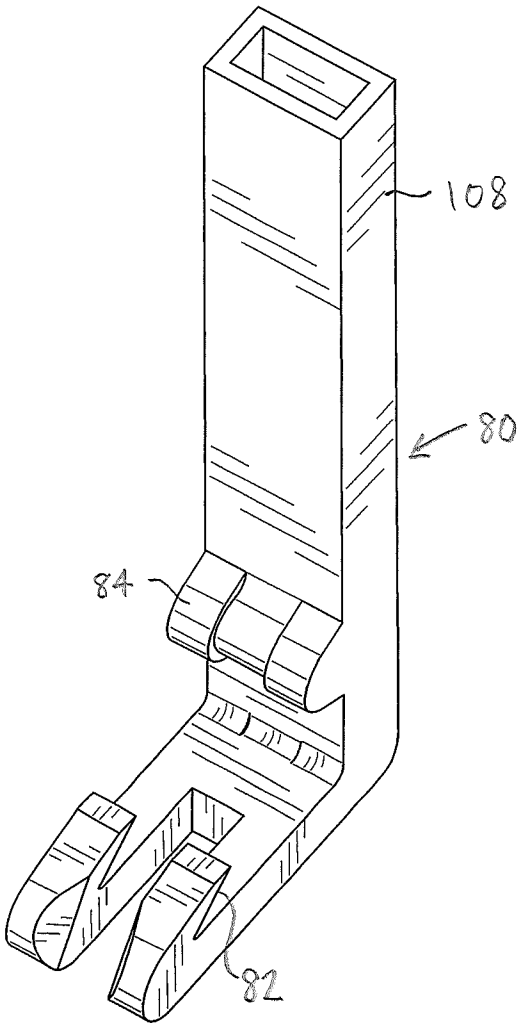
FIG. 3 is an isometric view of the installation tool of FIG. 2A.

Once the second clamping arm 50 is positioned with the locking portion 56 in the opening 48 and the second engagement portion 70 engaging the lower surface 74, the clip assembly 20 preferably is secured to the first and second tuned mass dampers 22, 24 by an installation tool 80. As can be seen in FIG. 3, the installation tool 80 preferably includes first and second contact portions 82, 84. To secure the clip assembly 20 to the first and second tuned mass dampers 22, 24, the first contact portion 82 preferably is engaged with the interior surface 60 of the bracing element 58, and the second contact portion 84 preferably is engaged with the second clamping arm 50, as will also be described.

As can be seen in FIGS. 1A-2A and 2C, it is preferred that the second clamping arm 50 additionally includes a bearing surface portion 86 located between the upper and lower ends 52, 54 thereof. Preferably, the bearing surface portion 86 has a planar bearing surface 88, and an internal side 89 located opposite to the bearing surface 86 (FIG. 1D). The installation tool 80 is used to secure the clip assembly 20 to the first and second tuned mass dampers 22, 24 by, with the tool 80, pulling in the first direction on the linkage section 44 while simultaneously pushing in the second direction on the bearing surface 88, as will be described. The first direction is generally indicated by arrow "A" in FIG. 2A, and the second direction is indicated by arrow "B" in FIG. 2A. As can be seen, e.g., in FIG. 2A, the result of this is that the bar element 32 and the second clamping arm 50 are urged toward each other, to simultaneously squeeze the first and second mass dampers 22, 24 between the first and second engagement portions 64, 70 respectively.

As can be seen in FIGS. 1D, 2A, and 2C, the second clamping arm 50 preferably is configured for cooperating with the linkage section 44 of the bar element 32, and also for cooperating with the installation tool 80, to secure the first engagement portion 64 and the second engagement portion 70 to the first and second tuned mass dampers 22, 24 respectively. In one embodiment, the locking portion 56 of the second clamping arm 50 preferably includes a linear locking portion body 90 that is positioned transverse to the bearing surface portion 86, to define an acute angle 92 between the locking portion body 80 and the internal side 89 of the bearing surface portion 86 (FIG. 1D).

As illustrated in FIGS. 1B and 1D, it is preferred that the locking portion body 90 has an upper surface 94 that is positioned to face upwardly when the locking portion 56 is received in the opening 48 in the curved wall 46, and a lower surface 96 positioned to face downwardly when the locking portion 56 is received in the opening 48 in the curved wall 46.

In one embodiment, the curved wall 46 of the linkage section 44 preferably includes a lower edge element 98 that a least partially defines the opening 46 (FIG. 2B). As can be seen in FIG. 1D, the lower surface 96 of the locking portion body 90 preferably includes a number of locking elements 102 that are formed for engagement with the lower edge element 98, to hold the locking portion 56 in the linkage section 44 in order to hold the second engagement portion 70 of the second clamping arm 50 against the second tuned mass damper 24.

Preferably, the locking elements 102 include a number of teeth 104 (FIG. 1D) that are configured to permit slidable engagement of the lower edge element 98 with the teeth 104, when the locking portion 56 is moved in the opening 48 in the second direction (i.e., indicated by arrow "B" in FIG. 2A) toward the first end 36 of the connector portion 34. The teeth 104 are also formed to engage the lower edge element 98 to prevent movement of the locking portion 56 in the first direction, i.e., to prevent movement of the locking portion 56 out of the opening 48, generally in the first direction.

It will be understood that the teeth 104 preferably define notches 106 therebetween respectively (FIG. 1D), and at least a portion of the lower edge element 98 of the curved wall 46 preferably is securely receivable in any one of the notches 106.

Preferably, after the clip assembly 20 has been manually installed as described above (i.e., with the first and second engagement portions 64, 70 lightly engaging the respective lower surfaces 68, 74, and the locking portion 56 received in the opening 48 of the curved wall 46), the first contact portion 82 of the installation tool 80 is pushed into the ballast 75, in the direction generally indicated by arrow "E" in FIG. 2A. Subsequently, the first contact portion 82 preferably is partially withdrawn from the ballast 75 in the direction generally indicated by arrow "F" in FIG. 2A, so that the first contact portion 82 can hook onto the bracing element 58. It is preferred that the first contact portion 82 engages the interior surface 60 of the bracing element 58, as illustrated in FIG. 2A.

Once the first contact portion 82 engages the bracing element 58, an upper end 108 of the installation tool 80 preferably is moved in the direction indicated by arrow "G" in FIG. 2A, to engage the second contact portion 84 of the installation tool 80 with the bearing surface 88 of the second clamping arm 50. As can be seen in FIG. 2A, when the upper end 108 is urged in the direction indicated by arrow "G", the second clamping arm 50 is urged by the installation tool 80 in the direction indicated by arrow "B".

At the same time as the second contact portion 84 urges the second clamping arm 50 in the direction indicated by arrow "B", the first contact portion 82 pulls the bracing element 58 generally in the direction indicated by arrow "F". Because the connector portion 34 is connected with the bracing element 58 via the curved wall 46, the connector portion 34 is pulled as a result in the direction indicated by arrow "C" in FIG. 2A. (As can be seen in FIG. 2A, the first direction "A" preferably is substantially parallel with the direction indicated by arrow "C".) In turn, the tension to which the connector portion 34 is subjected also urges the first clamping arm 42 in the direction indicated by arrow "A" in FIG. 2A. From the foregoing, it can be seen that applying the installation tool 80 as described above results in both of the first and second clamping arms 42, 50 being urged in opposite directions, i.e., toward the first and second sides 26, 28 of the rail 30 respectively. The result is that, simultaneously, the first engagement portion 64 is urged against the lower surface 68 of the first tuned mass damper 22, and the second engagement portion 70 is urged against the lower surface 74 of the second tuned mass damper 24.

It will also be understood that, when the first contact portion 82 urges the bracing element 58 in the direction indicated by arrow "F", the lower edge element 98 may be moved outwardly, i.e., in the direction indicated by arrow "C". In this way, when the installation tool 80 is applied to urge the first and second clamping arms 42, 50 generally toward each other as described above, the lower edge element 98 simultaneously is positioned in a selected notch 106 which can hold the first and second clamping arms 42, 50 in position, i.e., held then urged against the first and second tuned mass dampers 22, 24 respectively. Because of the positioning of the lower edge element 98 in the selected notch 106 when the installation tool 80 is applied, the bar element 32 and the second clamping arm 50 are held locked together thereby, when the installation tool 80 is removed.

Those skilled in the art would appreciate that the bar element and the second clamping arm may be made of any suitable material, or materials. For example, in one embodiment, the bar element 32 preferably is made of spring steel. This enables the connector portion 34 to deform upwardly toward the foot 40 of the rail 30, when the first and second engagement portions 64, 70 are urged against the first and second tuned mass dampers 22, 24 respectively. The upward deformation of the connector portion 34 is in the direction indicated by arrow "H" in FIG. 2A.

Also, those skilled in the art would appreciate that the second clamping arm 50 may be made of mild steel, or spring steel.

In one embodiment, the invention preferably includes a system 110 that includes the clip assembly 20 and the installation tool 80. In use, as outlined above, the linkage section 44 of the bar element 32 is inserted underneath the left (or first) side 76 of the foot 40 and pushed through the ballast 75 underneath the foot 40 until the connector portion 34 of the bar element 32 is in the predetermined location thereof, relative to the first and second tuned mass dampers 22, 24. At this point, the linkage section 44 preferably is generally proximal to the side 78 of the foot 40 that is below the second tuned mass damper 24, i.e., the linkage section is also in its predetermined location. When the connector portion 34 is in its predetermined location, the first clamping arm 42 is engaged with the first tuned mass damper 22.

Once the connector portion 34 and the linkage section 44 are in their predetermined locations, the locking portion body 90 of the locking portion 56 of the second clamping arm 50 is inserted into the opening 48 of the curved wall 46 of the linkage section 44, so that a selected one of a number of locking elements 102 on a lower surface of the locking portion body 90 is engageable with a lower edge element 98 of the curved wall 46 that partially defines the opening 48. The installation tool 80 is used to secure the second clamping arm 50 to the linkage section 44, as described above. Once the second clamping arm 50 is secured to the linkage section 44, the locking portion 56 of the second clamping arm 50 is held in the linkage section 44 by the lower edge element 98 engaging the selected one of the locking elements 102.

The installation tool 80 is positioned to engage the first contact portion 82 of the installation tool 80 with the bracing element 58 of the curved wall 46, and also to engage the second contact portion 84 thereof with the bearing surface 88 of the second clamping arm 50. With the first contact portion 82 of the installation tool 80, the bracing element 58 is pulled at least partially in the first direction, to urge the first clamping arm 42 against the first tuned mass damper 22. With the second contact portion 84 of the installation tool 80, pressure is exerted on the bearing surface 88 in the second direction, to urge the second clamping arm in the second direction against the second tuned mass damper 24.

As noted above, the tuned mass dampers 22, 24 preferably include a suitable elastomeric material. Due to the resilience of the spring steel of the bar element 32 and the resilience of the elastomeric material in the tuned mass dampers, the bar element 32 preferably is subjected to tension as the installation of the clip assembly 20 is completed, so that once the locking elements 102 are engaged with the lower edge element 98 of the curved wall 46, they tend to stay so engaged.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

I claim:

1. A clip assembly for securing first and second tuned mass dampers to respective first and second sides of a rail, the clip assembly comprising:

a bar element comprising:

a connector portion extending between first and second ends thereof and formed to be positioned in a predetermined location relative to the rail at least partially under a foot of the rail;

a first clamping arm connected with the connector portion at the first end of the connector portion, the first clamping arm being formed to engage the first tuned mass damper to urge the first tuned mass damper against the first side of the rail and at least partially downwardly toward the foot, when the connector portion is in the predetermined location;

a linkage section connected with the connector portion at the second end of the connector portion, the linkage section comprising a curved wall with an opening therein; and a second clamping arm extending between upper and lower ends thereof, the lower end comprising a locking portion at least partially receivable in the opening in the curved wall, the locking portion being securable to the linkage section, and the upper end being formed for engagement with the second tuned mass damper, to urge the second tuned mass damper against the second side of the rail and at least partially downwardly toward the foot.

2. The clip assembly according to claim 1 in which the curved wall additionally comprises at least one bracing element, said at least one bracing element comprising at least one interior surface defining a gap between said at least one interior surface and the connector portion.

3. The clip assembly according to claim 2 in which said at least one interior surface is planar, and said at least one interior surface defines an acute angle between said at least one interior surface and the connector portion.

4. The clip assembly according to claim 1 in which the first clamping arm comprises a first engagement portion, for engaging the first tuned mass damper.

5. The clip assembly according to claim 4 in which the first engagement portion defines a first acute angle between the first engagement portion and the connector portion, wherein, when the first clamping arm is urged in a first direction against the first tuned mass damper, the first engagement portion pushes simultaneously in a first horizontal direction toward the rail and in a first downward direction toward the foot of the rail.

6. The clip assembly according to claim 1 in which the second clamping arm comprises a second engagement portion at the upper end thereof, for engaging the second tuned mass damper.

7. The clip assembly according to claim 6 in which the second engagement portion defines a second acute angle between the second engagement portion and the locking portion, wherein, when the second clamping arm is urged in a second direction against the second tuned mass damper, the second engagement portion pushes simultaneously in a second horizontal direction toward the rail and in a second downward direction toward the foot of the rail.

8. The clip assembly according to claim 6 in which the second clamping arm additionally comprises a bearing surface portion located between the upper and lower ends thereof, the bearing surface portion comprising a planar bearing surface and an internal side located opposite to the bearing surface.

9. The clip assembly according to claim 8 in which the locking portion comprises a linear locking portion body that is positioned transverse to the bearing surface portion, to define an acute angle between the locking portion body and the internal side of the bearing surface portion.

10. The clip assembly according to claim 9 in which the locking portion body comprises an upper surface that is positioned to face upwardly when the locking portion is received in the opening in the curved wall, and a lower surface positioned to face downwardly when the locking portion is received in the opening in the curved wall.

11. The clip assembly according to claim 10 in which:

the curved wall of the linkage section comprises a lower edge element partially defining the opening; and the lower surface of the locking portion body comprises a plurality of locking elements formed for engagement with the lower edge element, to hold the locking portion in the linkage section in order to hold the second engagement portion of the second clamping arm against the second tuned mass damper.

12. The clip assembly according to claim 11 in which the locking elements comprise a plurality of teeth configured to permit slidable engagement of the lower edge element with the teeth when the locking portion is moved in the opening in a second direction toward the first end of the connector portion and to engage the lower edge element to prevent movement of the locking portion in a first direction that is opposed to the second direction.

13. The clip assembly according to claim 12 in which the bar element comprises spring steel and the connector portion tends to deform upwardly toward the foot of the rail, when the first and second engagement portions are urged against the first and second tuned mass dampers respectively.

14. A system comprising:

a clip assembly for securing first and second tuned mass dampers on respective first and second sides of a rail, the clip assembly comprising:

a bar element comprising:

a connector portion extending between first and second ends thereof and formed to be positioned in a predetermined location relative to the rail at least partially under a foot of the rail;

a first clamping arm connected with the connector portion at the first end of the connector portion, the first clamping arm being formed to engage the first tuned mass damper to urge the first tuned mass damper against the first side of the rail and at least partially downwardly toward the foot, when the connector portion is in the predetermined location;

a linkage section connected with the connector portion at the second end of the connector portion, the linkage section comprising a curved wall with an opening therein;

a second clamping arm extending between upper and lower ends thereof, the lower end comprising a locking portion at least partially receivable in the opening in the curved wall, the locking portion being securable to the linkage section, and the upper end being formed for engagement with the second tuned mass damper, to urge the second tuned mass damper against the second side of the rail and at least partially downwardly toward the foot; and an installation tool configured for engagement with the curved wall and the second clamping arm, for urging the first and second clamping arms against the first and second tuned mass dampers respectively, and to secure the locking portion to the linkage section.

15. The system according to claim 14 in which:

the second clamping arm extends between upper and lower ends thereof, the upper end being engageable with the second tuned mass damper and the lower end being securable to the linkage section;

the second clamping arm additionally comprises a bearing surface portion positioned between the upper and lower ends thereof, for engagement with the installation tool; and the installation tool is engageable with a bracing element of the curved wall, when the installation tool engages the bearing surface of the second clamping arm, wherein the installation tool simultaneously pushes the bearing surface at least partially in a second direction toward the second tuned mass damper, and pulls the first clamping arm at least partially in a first direction opposed to the second direction, toward the first tuned mass damper.

16. The system according to claim 15 in which said at least one interior surface defines a gap between at least one interior surface on the bracing element and the connector portion.

17. The system according to claim 16 in which the installation tool comprises:

an elongate installation tool body, with at least one engagement element connected with the body; and said at least one engagement element comprising at least one first contact portion, for engaging the bracing element.

18. The system according to claim 17 in which the installation tool additionally comprises a second contact portion formed for slidable engagement with the bearing surface of the second clamping arm when said at least one first contact portion engages the bracing element.

19. A method of installing a clip assembly for securing first and second tuned mass dampers on respective first and second sides of a rail, the method comprising:

(a) inserting a linkage section of a bar element of the clip assembly underneath a first side of a foot of the rail;

(b) pushing the linkage section in a first direction underneath the foot of the rail, to position a connector portion of the bar element in a predetermined location relative to the first and second tuned mass dampers, and to engage a first clamping arm that is connected with the connector portion with the first tuned mass damper;

(c) inserting a locking portion body of a locking portion at the lower end of a second clamping arm of the clip assembly into an opening in a curved wall of the linkage section, to engage a locking element positioned on a lower surface of the locking portion body with a lower edge element of the curved wall that partially defines the opening, to hold the locking portion of the second clamping arm in the linkage section;

(d) positioning an installation tool to engage at least one first contact portion thereof with the bracing element, and to engage at least one second contact portion thereof with the bearing surface of the second clamping arm; and (e) with said at least one first contact portion, pulling the bracing element at least partially in the first direction, to urge the first clamping arm in the first direction against the first tuned damper element, and simultaneously with said at least one second contact portion, urging the second clamping arm in the second direction against the second tuned damper element.

20. A system for damping airborne vibrations from a rail generated by wheels rolling over the rail, the rail comprising a web portion supported by a foot, the system comprising:

first and second tuned mass dampers, the first and second tuned mass dampers being engaged with opposite first and second sides of the web portion and being at least partially supported by the foot of the rail, each said tuned mass damper comprising:

a body comprising an elastomeric material and at least one insert element embedded in the elastomeric material;

the body comprising an inner side formed for engagement with the web portion and an outer side of the body opposite to the inner side thereof, the outer side comprising an upper part and a lower part formed to be located below the upper part when the inner side of the tuned mass damper is engaged with the web portion, the upper and lower parts being at least partially separated by a slot with a recessed region therein defined by upper and lower surfaces positioned at least partially inwardly from the outer side;

a clip assembly for securing the first and second tuned mass dampers to the respective first and second sides of a rail, the clip assembly comprising:

a bar element comprising:

a connector portion extending between first and second ends thereof and formed to be positioned in a predetermined location relative to the rail at least partially under the foot of the rail;

a first clamping arm connected with the connector portion at the first end of the connector portion, the first clamping arm being formed to engage the lower surface of the first tuned mass damper to urge the first tuned mass damper against the first side of the rail and at least partially downwardly toward the foot, when the connector portion is in the predetermined location;

a linkage section connected with the connector portion at the second end of the connector portion, the linkage section comprising a curved wall with an opening therein; and a second clamping arm extending between upper and lower ends thereof, the lower end comprising a locking portion at least partially receivable in the opening in the curved wall, the locking portion being securable to the linkage section, and the upper end being formed for engagement with the lower surface of the second tuned mass damper, to urge the second tuned mass damper against the second side of the rail and at least partially downwardly toward the foot.

* * * * *